US005350543A

United States Patent [19]

Spradley

[11] Patent Number: 5,350,543

[45] Date of Patent: Sep. 27, 1994

[54] METHOD AND APPARATUS FOR AERATING AN AQUEOUS SOLUTION

[76] Inventor: William E. Spradley, 4914 Maple, Bellaire, Tex. 77401

[21] Appl. No.: 883,295

[22] Filed: May 14, 1992

[51] Int. Cl.[5] ..... B01F 3/04

[52] U.S. Cl. ..... 261/36.1; 261/DIG. 75; 261/64.1

[58] Field of Search ..... 261/36.1, DIG. 75, 64.1

[56] References Cited

U.S. PATENT DOCUMENTS

| | | | |
|---|---|---|---|
| 2,653,801 | 9/1953 | Fontein et al. | 261/DIG. 75 |
| 3,400,818 | 9/1968 | Tarjan | 261/DIG. 75 |
| 3,640,516 | 2/1972 | Willinger | 261/DIG. 75 |
| 3,662,890 | 5/1972 | Grimshaw | 261/DIG. 75 |
| 3,671,022 | 6/1972 | L0535055741. | 261/DIG. 75 |
| 3,794,303 | 2/1974 | Hirshon | 261/DIG. 75 |
| 4,244,815 | 1/1981 | Chaikin et al. | 210/622 |
| 4,265,741 | 5/1981 | Im | 209/211 |
| 4,271,099 | 6/1981 | Kukia | 261/76 |
| 4,389,312 | 6/1983 | Beard | 261/77 |
| 4,606,822 | 8/1986 | Miller | 209/170 |
| 4,614,596 | 9/1986 | Wyness | 210/754 |
| 5,091,118 | 2/1992 | Burgher | 261/DIG. 75 |

FOREIGN PATENT DOCUMENTS

| | | | |
|---|---|---|---|
| 550564 | 12/1922 | France | 261/DIG. 75 |
| 2059790 | 4/1981 | United Kingdom | 261/DIG. 75 |

*Primary Examiner*—Tim Miles

*Attorney, Agent, or Firm*—Gunn & Kuffner

[57] ABSTRACT

A method and apparatus for aerating an aqueous solution is disclosed comprising a vortex cylinder for receiving an aqueous solution stream under pressure. The aqueous solution stream is tangentially injected into the vortex cylinder forming a descending swirling vortex of aqueous solution. The swirling vortex develops a negative pressure zone for drawing air into the vortex through an air intake tube open to ambient pressure. The air and aqueous solution are mixed in a mixing chamber for supersaturating the aqueous solution with dissolved oxygen.

10 Claims, 1 Drawing Sheet

FIG.1
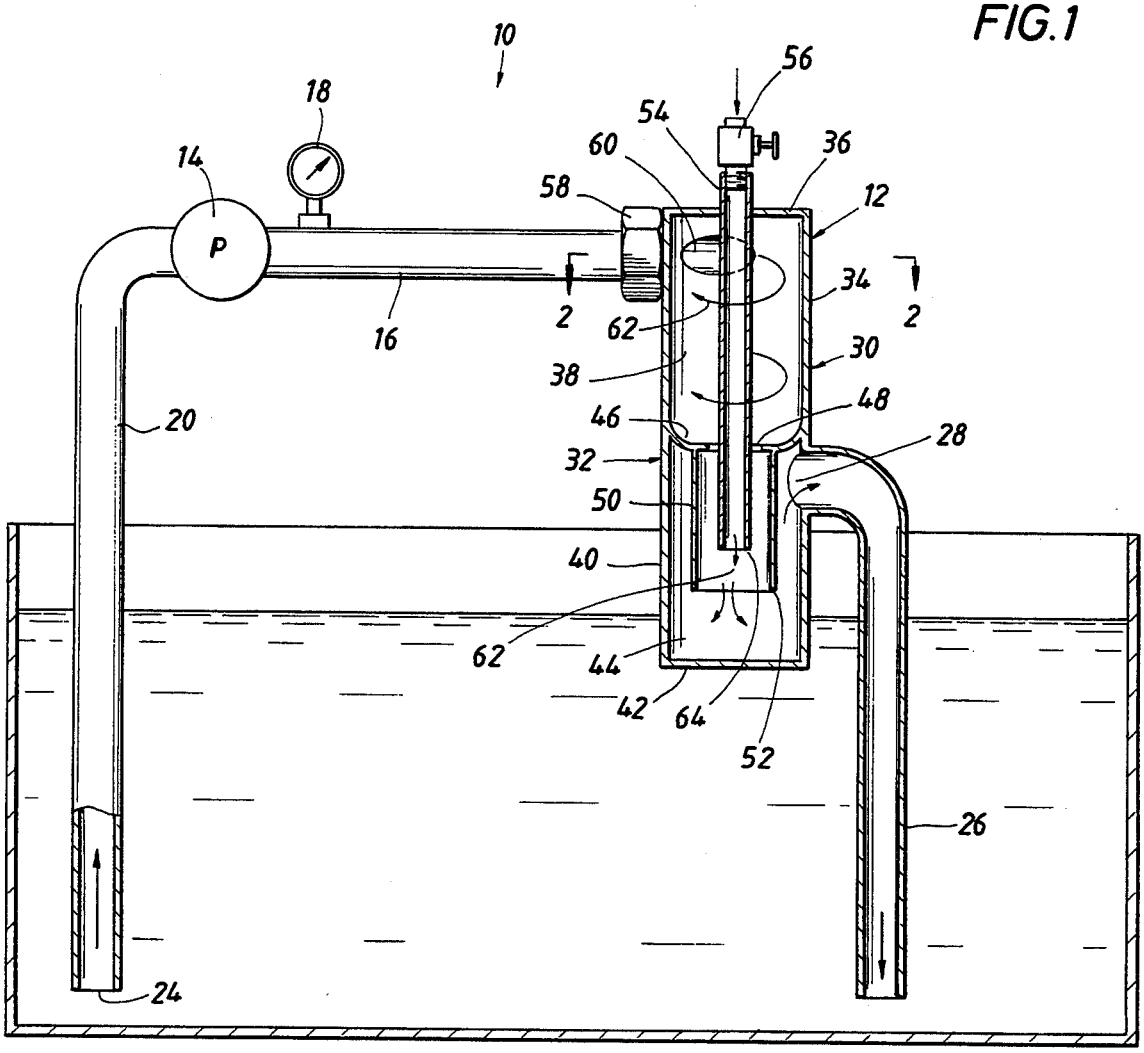
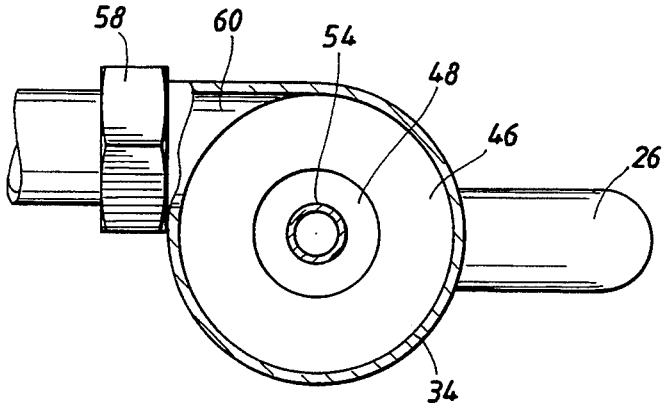
FIG. 2

METHOD AND APPARATUS FOR AERATING AN AQUEOUS SOLUTION

BACKGROUND OF THE DISCLOSURE

This invention relates to a system for aerating an aqueous solution, particularly to a system for supersaturating an aqueous solution with oxygen.

Oxygen transfer within an aqueous solution is a process having utility in a variety of industries, particularly the waste management industry. In the past twenty years, the waste management industry has found that oxygen induced into effluent greatly encourages growth of aerobic bacteria. Aerobic bacteria is one of two basic processes employed in the treatment of sanitary sewerage. Aerobic bacteria is most desired in that it is active, thereby reducing the time of processing waste materials, and it produces a high quality effluent that can be introduced into navigable waters, streams, lakes or disbursed on to land.

Although aerobic bacteria is efficient and effective, there are a number of factors that must be considered when designing a waste management process which will utilize aerobic bacteria. A primary factor is the cost of mechanical equipment for nurturing the growth of aerobic bacteria and assisting its positive influence. Another factor is the destruction of aerobic bacteria by foreign material present in the effluent. In some instances, aerobic bacteria microbes greatly diminish or cease activity due to lack of sufficient levels of oxygen in the effluent.

In the past twenty years, a number of aeration devices have been used to aid aerobic waste management systems. For example, floating mixers, spray ponds and air lifts have all been used in aerobic digestion. A commonly employed system utilizes an air compressor to induce large volumes of air into the system. While this technique has encountered some success, it has the disadvantage of being unable to sufficiently oxygenate the effluent to permit efficient utilization of oxygen by the aerobic bacteria.

It is therefore an object of the present invention to provide a system for the treatment of liquid waste by intimately mixing the liquid waste with air so that oxygen is dissolved therein, thereby providing a desirable environment for aerobic bacteria activity and oxidation of the liquid waste.

It is another object of the invention to provide a system for dissolving oxygen in an aqueous solution by creating a low pressure vortex in the aqueous stream for drawing air into the aqueous solution until it is supersaturated with oxygen.

It is yet another object of the invention to provide a process for creating negative pressure in a vortex chamber in the range up to thirty inches of mercury (Hg) for pumping large volumes of air into a aqueous solution stream passing through the vortex chamber.

It is a further object of the invention to provide a process and apparatus for oxygenating an aqueous solution which is comparatively simple in design, relatively inexpensive to manufacture and highly effective in performance.

SUMMARY OF THE INVENTION

According to one aspect of the invention, an aqueous stream is pumped through a vortex cylinder. The aqueous stream is rotated in a downwardly moving spiral stream within the vortex cylinder at a high downward velocity. The downward velocity of the aqueous stream is increased as it is passed through a discharge conduit concentrically located within a mixing chamber of the vortex cylinder. An air inlet tube open to atmospheric pressure extends through the vortex chamber and into the discharge conduit. A negative pressure zone is created at the discharge end of the discharge conduit for drawing air into the aqueous stream for mixing therewith and dissolving oxygen in the aqueous solution.

DETAILED DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 1 is an elevational view, partially in section and partially broken away, of the apparatus of the invention for dissolving a gas in an aqueous stream; and FIG. 2 is a cross-sectional view taken along line 2—2 of FIG. 1.

DETAILED DESCRIPTION OF THE PREFERRED EMBODIMENT

Referring first to FIG. 1, the air injection system of the invention is generally identified by the reference numeral 10. As shown in FIG. 1, the system 10 comprises a vortex cylinder 12 and a pump 14. The pump 14 is connected to the vortex cylinder 12 by a pipe conduit 16. A gauge 18 is located between the pump 14 and the vortex cylinder 12 to monitor the pressure of the aqueous solution as it is pumped to the vortex cylinder 12.

A suction hose 20 is connected to the inlet end of the pump 14. The suction hose 20 is of sufficient length to reach the bottom of a tank, lagoon or collection pond 22. The inlet end 24 of the suction hose 20 may be capped with a screen or the like to screen out solid debris such as rocks, wood, twigs or the like which may clog the pump 14. A discharge hose 26 is connected to a discharge port or opening 28 of the vortex cylinder 12. The discharge hose 26 discharges the aerated aqueous solution at the bottom of the pond 22. Thus, excess or free oxygen in the discharged aerated aqueous solution perculates upwardly through the aqueous solution in the pond 22 so that the dissolved oxygen level throughout the pond 22 is elevated to the saturation point relatively quickly.

Referring again to FIG. 1, the vortex cylinder 12 includes an upper section 30 and a lower section 32. The upper section 30 consists of a cylindrical wall 34 closed at the top end thereof by an upper wall 36 to define an upper cylindrical chamber 38. The lower section 32 consists of a cylindrical wall 40 closed by a bottom wall 42 defining a lower cylindrical chamber 44. The upper cylindrical chamber 38 is separated from the lower cylindrical chamber 44 by an inwardly sloping wall 46 defining the lower end of the upper cylindrical chamber 38. The wall 46 circumscribes an opening 48 providing access between the upper cylindrical chamber 38 and the lower cylindrical chamber 44. The bottom wall 46 of the upper cylindrical chamber 38 is provided with an axially disposed discharge conduit 50 extending downwardly therefrom into the lower cylindrical chamber 44. The discharge conduit 50 is concentrically disposed within the lower cylindrical chamber 44 and terminates at an end 52 at a point above the bottom 42 of the lower cylindrical chamber 44.

The top wall 36 of the upper cylindrical chamber 38 is provided with an axially disposed opening in which there is mounted an axially disposed air intake tube 54. The air intake tube 54 extends through the opening 48 into the discharge conduit 50. The air intake tube 54 is concentrically positioned within the discharge conduit 50 and terminates at a point above the end 52 of the discharge conduit 50. The upper end of the air intake tube 54 is provided with a valve 56 which may be opened to permit air to be drawn into the discharged conduit 50 for mixing with the aqueous solution pumped through the vortex cylinder 12. The rate of air flow into the air intake tube 54 may be adjusted by manipulation of the valve 56 as desired.

In the operation of the system 10, the aqueous solution is injected tangentially into the upper end of the upper cylindrical chamber 38 through the inlet conduit 16. The inlet conduit 16 is provided with a nozzle 58 which terminates in a nozzle opening 60 which is offset from the longitudinal axis of the vortex cylinder 12. As the aqueous solution is injected into the upper chamber 38 at a high velocity, it impinges on the cylindrical wall 34 and produces a swirling vortex descending downwardly in the upper chamber 38 as noted by the arrows 62. The swirling vortex has a constant radius in the cylindrical chamber 38, which radius in limited by the radius of the chamber 38. As the swirling vortex extends downward into the upper cylindrical chamber 38, it is forced through the opening 48 into the discharge conduit 50. As it extends downwardly into the discharge conduit 50 which has an internal diameter less than the internal diameter of the upper cylindrical chamber 38, the swirling aqueous stream is compacted and the velocity of the vortex is increased so that a negative pressure zone is created in the core of the vortex at the point 62 within the discharge conduit 50 just below the end 64 of the air intake tube 54. The radius of the swirling vortex is also decreased within the discharge conduit 50. As the aqueous solution descends in a vortex in the discharge conduit 50, centrifugal forces acting on the aqueous solution increase the velocity of the aqueous solution and create the negative pressure zone 62. The pressure drop in the low pressure zone 62 may reach thirty inches of mercury (Hg) creating a substantial pressure drop across the end 64 of the air intake tube 54. At the pressure differential developed by the system 10, air velocity exiting the air intake tube 54 is in the range of 700 to 1,000 feet per second generating a volume of 30 to 60 feet per minute of air aspirated in the aqueous solution discharged through the discharge conduit 50. The air and aqueous solution are mixed in the lower cylindrical chamber 44 and the oxygen rich aqueous solution is discharged through the discharge hose 26 into the collection pond 22.

Experimentation with the system 10 produced results indicating that an aqueous solution may be supersaturated with oxygen in a relatively short period of time. A test of the system 10 was conducted on a 155,000 gallon reservoir. Weather conditions, water conditions and dissolved oxygen (DO) were measured and recorded as a prelude to the test. Dissolved oxygen and water temperature were recorded at ten locations around the reservoir. The dissolved oxygen was determined to be 9.6 ppm. A ten percent solution of sodium sulfite was used to reduce the dissolved oxygen in the reservoir to an average of 2.7 ppm. The test conditions were as follows:

| | |
|---|---|
| Ambient temperature | 20 degrees centigrade |
| Water temperature | 15 degrees centigrade |
| Barometric Pressure | 28.2 mm Hg |
| Relative Humidity | AM-80; PM-65 |
| Wind Velocity | 8–10 mph |
| Wind Direction | Northeast |
| Cloud Conditions | Partly Cloudy |
| Date | December 19, 1990 |
| Time | 8:00 AM CST |
| Time (test) | 11:17 AM–2:25 PM |
| Water | Clear, debris free potable |
| Chlorine Content | 0.3 ppm |
| pH | 7.5 |

The system 10 of the invention was placed in service at 11:17 AM. A fifteen foot long, three inch diameter suction hose 20 conducted water from the bottom of the reservoir 22. The water was pumped through the vortex cylinder 12 and the oxygen enriched liquid was returned into the reservoir 22 via a four inch plastic discharge pipe 26 to a depth of ten feet.

Based upon the capacity of the pump and the volume of the reservoir 22, it was calculated that a period of approximately eight hours would be required to theoretically pass the entire volume of the reservoir 22 through the system 10. Temperature and dissolved oxygen were measured at designated locations about the reservoir. The schedule was based upon an arbitrary estimate that the oxygen saturation level would be reached within a period of approximately six hours.

At the beginning of the test the dissolved oxygen was 2.71 ppm. At the end of one hour the dissolved oxygen was 6.80 ppm. At the end of the second recorded hour the dissolved oxygen was 15.46 ppm. At the end of the third hour the test was terminated. The average dissolved oxygen in the reservoir was 16.62 ppm. The published dissolved oxygen saturation point of water at 20° centigrade is 9.2 ppm. The system 10 of the invention supersaturated the tested reservoir with approximately 25% of the theoretical volume of water passing through the vortex cylinder 12. The system 10 is thus particularly suited for dissolving oxygen in an aqueous solution in a relatively quick and efficient manner.

It will be understood that certain combinations and subcombinations of the invention are of utility and may be employed without reference to other features in sub-combinations. This is contemplated by and is within the scope of the present invention. As may possible embodiments may be made of this invention without departing from the spirit and scope thereof. It is to be understood that all matters hereinabove set forth or shown in the accompanying drawings are to be interpreted as illustrative and not in a limiting sense.

While the foregoing is directed to the preferred embodiment, the scope thereof is determined by the claims which follow.

What is claimed:

1. An apparatus for aerating an aqueous solution, comprising:

(a) a vortex cylinder having an upper vortex chamber and a lower mixing chamber;

(b) inwardly sloping wall means separating said upper vortex chamber and said lower mixing chamber, said wall means circumscribing an opening for providing fluid communication between said upper vortex chamber and said lower mixing chamber;

(c) an axially disposed discharge conduit depending downwardly from said wall means into said mixing chamber;

(d) an axially disposed air intake tube extending through said upper vortex chamber into said discharge conduit;

(e) means for tangentially injecting an aqueous solution into said vortex chamber for creating a swirling vortex of aqueous solution descending through said vortex chamber; and (f) pump means for drawing the aqueous solution from the bottom of a collection reservoir, pumping the aqueous solution through said vortex cylinder and discharging the aerated aqueous solution at the bottom of the reservoir.

2. The apparatus of claim 1 wherein said discharge conduit circumscribes said opening in said wall means, said swirling vortex of aqueous solution descending through said opening into said discharge conduit.

3. The apparatus of claim 2 wherein said swirling vortex of aqueous solution creates a negative pressure zone at the lower end of said discharge conduit.

4. The apparatus of claim 3 wherein said negative pressure zone is in the range of thirty inches of mercury (Hg).

5. The apparatus of claim 1 wherein said tangential injection means comprises an inlet nozzle having a discharge opening offset radially relative to the longitudinal axis of said vortex cylinder.

6. The apparatus of claim 1 wherein said air intake tube includes valve means for adjusting the volume of air drawn into said negative pressure zone for mixing with the aqueous solution.

7. A method of aerating an aqueous solution comprising the steps of:

(a) injecting the aqueous solution tangentially into a vortex cylinder forming a descending swirling vortex having a constant radius for a predetermined axial distance in the direction of flow;

(b) directing the swirling vortex into a discharge conduit;

(c) decreasing the radius of the descending swirling vortex within the discharge conduit;

(d) creating a negative pressure zone in the core of the descending swirling vortex at the lower end of said discharge conduit;

(e) aspirating air into the swirling vortex of aqueous solution within the discharge conduit;

(f) mixing the air with the aqueous solution for dissolving oxygen in the aqueous solution; and (g) discharging the oxygenated aqueous solution into a collection pond.

8. The method of claim 7 including the step of drawing air into the negative pressure zone through an air intake tube open to ambient pressure.

9. The method of claim 8 including the step of regulating the volume of air drawn into the swirling vortex of aqueous solution.

10. The method of claim 9 including the step of pumping aqueous solution from the bottom of the collection pond and discharging the oxygenated aqueous solution at the bottom of the collection pond.

* * * * *